United States Patent [19]

Miyashita

[11] 4,417,605

[45] Nov. 29, 1983

[54] FABRIC WEAVING METHOD

[76] Inventor: Shoji Miyashita, No. 3809, Koasumi, Fujiyoshida, Yamanashi Pref., Japan

[21] Appl. No.: 301,894

[22] Filed: Sep. 11, 1981

[30] Foreign Application Priority Data

Sep. 25, 1980 [JP] Japan ..... 55-133527

[51] Int. Cl.[3] ..... D03D 23/00; D03C 13/00

[52] U.S. Cl. ..... 139/383 R; 139/55.1; 139/82

[58] Field of Search ..... 139/383 R, 82, 55.1, 139/416

[56] References Cited

U.S. PATENT DOCUMENTS 1,910,595 5/1933 Deboutteville ..... 139/82 X

FOREIGN PATENT DOCUMENTS 1262169 2/1968 Fed. Rep. of Germany ..... 139/55.1
1148627 6/1957 France ..... 139/383 R
54-30972 3/1979 Japan ..... 139/55.1

*Primary Examiner*—James Kee Chi
*Attorney, Agent, or Firm*—Wenderoth, Lind & Ponack

[57] ABSTRACT

Fabric weaving method, which applies to producing a plain fabric, a twill fabric and a satin fabric, comprising providing two parallel groups each consisting of a certain number of heddle harness frames each of which carries every nth heddle of the succeeding heddles which alternate as a multiple of a certain number, and causing successive adjacent heddles to be operated by the corresponding harness frames in the different harness frame groups. In one embodied form, each individual heddle alternates between the different groups in being raised or lowered to permit the corresponding warp yarns to be raised or lowered, for each succeeding weft shooting or picking process. In another embodied form, each pair of heddle harness frames, one in one group and the other in the other group, alternates in being raised or lowered to permit the corresponding warp yarns to be raised or lowered for each suceeding weft shooting or picking process.

4 Claims, 9 Drawing Figures

FABRIC WEAVING METHOD

BACKGROUND OF THE INVENTION

1. Field of the Invention

The present invention relates to a fabric weaving method, and more particularly to a process for weaving a plain fabric, a twill fabric and a satin fabric which permits a closely or tightly woven cloth to be produced.

2. Description of the Prior Art

Usually, the fabric structures obtained by intersecting the warp and weft yarns can be classified in the three fundamental weaving systems, which are the linen or plain weave, twill weaves, and satin weaves. In addition, there are also known the derived weaves obtained by modifying the above fundamental weaves, such as the rib weaves and panama weaves. Those conventional different weaves are employed depending upon the specific usage of the fabrics to be woven. However, the needs arise for devising a novel method which permits a tightly woven cloth to be produced.

SUMMARY OF THE INVENTION

An object of the present invention is therefore to provide a novel fabric weaving method which is capable of producing a tightly woven fabric structure.

According to the present invention, the above object is achieved in the following manner. Two groups of heddle harness frames are provided in parallel, each group including a certain number of heddle harness frames arranged in parallel and operated to be raised and lowered. Each heddle harness frame in the two groups carries every nth heddle of the succeeding heddles which alternate as a multiple of a certain number, and successive adjacent warp yarns are operated by the corresponding heddles in the different groups. In one embodied form, each individual heddle alternates between the different groups in being raised or lowered to permit the corresponding warp yarns to be raised or lowered, for each succeeding weft shooting or picking process. In another embodied form, each pair of heddles, one heddle of which belongs to one harness frame group and the other heddle of which belongs to the other group, alternates in being raised or lowered to permit the corresponding warp yarns to be raised or lowered, for each succeeding weft shooting or picking process. In both embodiments, it is thus possible to produce a tightly woven cloth including two or more layered fabric structures at one time during the weaving process.

BRIEF DESCRIPTION OF THE DRAWING

These and other objects of the present invention will more clearly be seen from the following description to be made in conjunction of the embodiments shown in the accompanying drawings, in which.

DETAILED DESCRIPTION OF THE PREFERRED EMBODIMENTS

Figure 1:
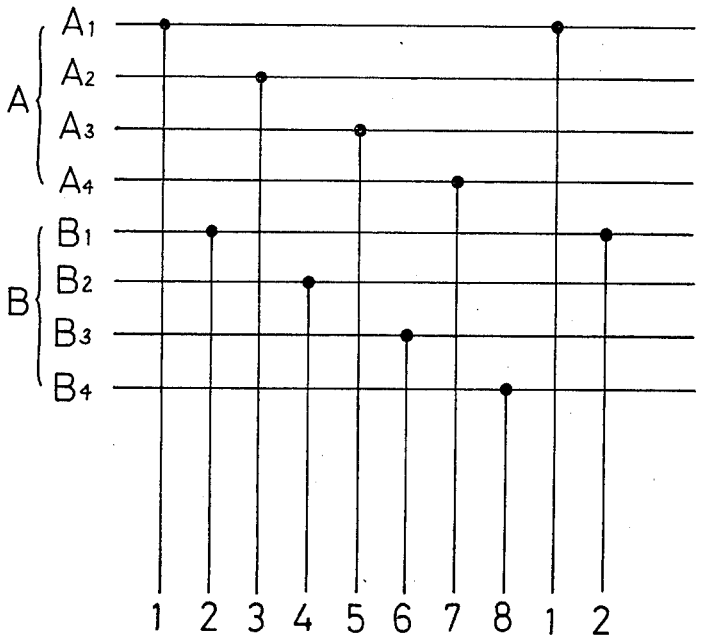
FIG. 1 illustrates the arrangement of part of the two harness frame groups, each group consisting of a certain number of parallel heddle harness frames to which the appropriate heddles are attached, according to a first embodied form of the present invention.

In a first preferred embodiment of the present invention shown in FIG. 1, in which an eight-frame textured satin fabric is to be produced, two groups of a total of eight heddle harness frames are arranged in parallel, group A consisting of four heddle harness frames A1, A2, A3, A4 and group B consisting of four heddle harness frames $B_1$, $B_1$, $B_3$, $B_4$. Successive groups of heddles for receiving warp yarns are provided, each group consisting of eight heddles which alternate as a mutliple of eight, such as heddles 1, 2, 3, 4, 5, 6, 7, 8, 1, 2, . . . , 8, and so forth as shown, and the individual heddles in each heddle group are attached to the appropriate harness frames in the two frame groups A and B in the following manner. That is, alternate heddles 1, 3, 5, 7 in each heddle group are operatively attached to the corresponding harness frames in group A in the order of $A_1$, $A_2$, $A_3$, $A_4$, while the remaining heddles 2, 4, 6, 8 in the same heddle group are operatively attached to the corresponding harness frames in group B in the order of $B_1$, $B_2$, $B_3$, $B_4$. The other succeeding groups of eight heddles each are attached to the harness frames in the same manner. As readily noted, any two adjacent heddles in each heddle group are operatively linked to the harness frames in the different frame groups, such that for example, adjacent heddles 1 and 2 are linked to frames A and B, respectively, adjacent heddles 3 and 4 are linked to frames $A_2$ and $B_2$, respectivly, and so forth.

In the above described embodiment, the raising or lowering operation of the heddle harness frames alternates between the two different groups A and B in the sequence of $A_1$, $B_3$, $A_2$, $B_4$, $A_3$, $B_1$, $A_4$, $B_2$, for each process of laying weft yarns between the warp yarns, and the sequence is repeated in each succeeding weft shooting process. Thus, this operation causes the corresponding heddles to be raised or lowered in the sequence of 1, 6, 3, 8, 5, 2, 7, and 4, permitting the corresponding warp yarns to cross the weft yarns over the same. With this embodiment, a tightly textured satin cloth can be produced, which comprises an eight-frame woven structure including two overlapped four-frame satin weaves, one four-frame weave being obtained by raising or lowering the heddle harness frames in the frame group A in the sequence of $A_1$, $A_2$, $A_3$, $A_4$ to permit corresponding heddles to be raised or lowered accordingly in the sequence of 1, 3, 5, 7 and by thus allowing the weft yarns to pass between the warp yarns, and the other four-frame weave being obtained by raising or lowering the heddle harness frames in the frame group B in the sequence of $B_1$, $B_2$, $B_3$, $B_4$ to cause the corresponding heddles to be raised or lowered accordingly in the sequence of 2, 4, 6, 8 and by thus allowing the weft yarns to pass between the warp yarns.

Figure 2:
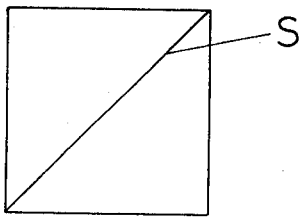
FIG. 2 is an illustrative diagram showing the surface of the satin weave produced according to the prior art method.
Figure 3A:
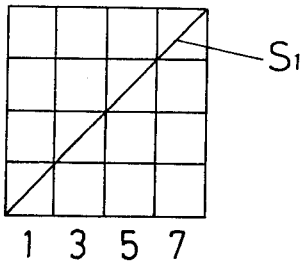
FIGS. 3(*a*), 3(*b*) and 3(*c*) are illustrative diagrams showing the surface of the satin weave produced according to the first embodiment of the present invention.
Figure 3B:
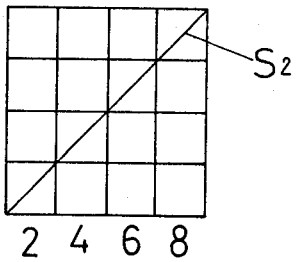
Figure 3C:
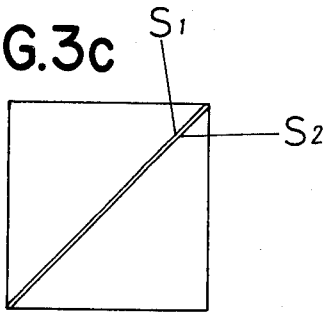

When the surface of the eight-frame woven satin fabric according to the conventional weaving method is observed with naked human eyes, a diagonal light line (binding) S is recognized to be present across the surface of each individual woven structure (including eight warp and weft yarns). The diagonal light line S is illustrated in FIG. 2. As clearly distinguished from the prior art eight-frame woven satin fabric, the eight-frame satin fabric woven by the above-described embodiment includes a diagonal light line $S_1$ across the four-frame satin weave (FIG. 3(*a*)) produced by sequentially raising or lowering the heddle harness frames $A_1$, $A_2$, $A_3$, Ahd 4 in group A to cause the corresponding heddles 1, 3, 5, 7, to be raised or lowered and by thus allowing the weft yarns to pass between the warp yarns, and a diagonal light line $S_2$ across the four-frame satin weave (FIG. 3(*b*)) produced by sequentially raising or lowering the heddle harness frames $B_1$, $B_2$, $B_3$, $B_4$ in the the group B to cause the corresponding heddles 2, 4, 6, 8 to be raised or lowered and by thus allowing the weft yarns to pass between the warp yarns. Thus, the two diagonal lines $S_1$ and $S_2$ appear to be one over the other as illustrated in FIG. 3(*c*).

As noted from the foregoing description, the satin weave according to the above embodiment presents a tightly woven fabric structure. This permits the use of even thinner threads or yarns which provides an improved strength and light-weight fabric. To provide a better understanding of the advantage of the present invention over the prior art in this respect, comparison in weight is now made between the eight-frame satin fabrics of similar patterns which have been produced according to the present invention and the prior art, respectively. The prior art satin fabric is provided by weaving warp yarn pairs (including two yarns for each heddle) No. 20 totaling 10000 pairs per meter of width and 120 denier (120D) weft yarns totaling 4734 yarns per meter of length, weighing about 295 g per meter of cloth. In contrast, the satin weave produced by the present invention comprises warp yarn pairs No. 20 totaling 10000 yarn pairs per meter of width and 100 denier (100D) weft yarns totaling a lesser number of 4208 yarns per meter of length, weighing about 220 g per meter of cloth.

Figure 4:
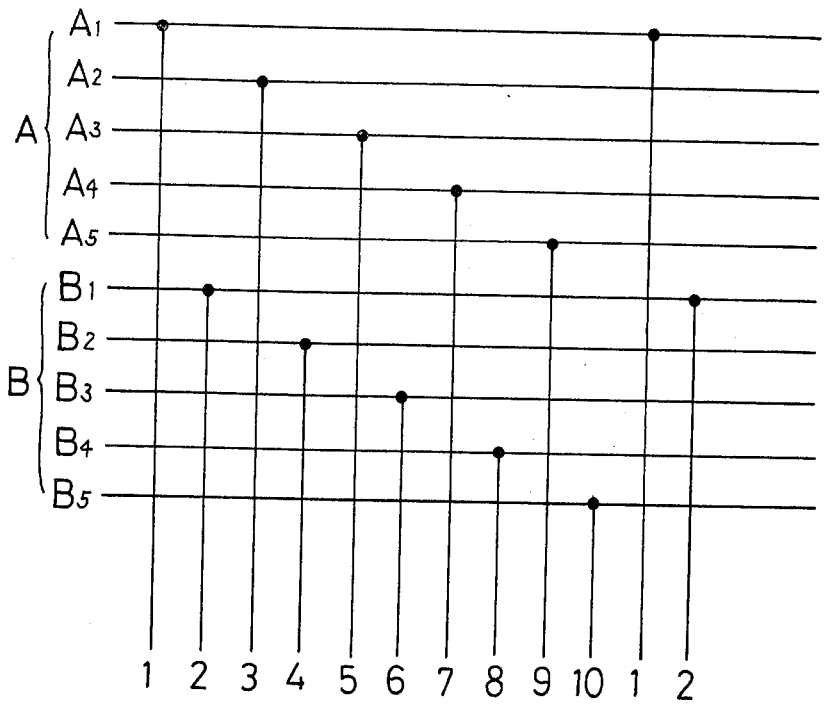
FIG. 4 illustrates the arrangement of part of the two harness groups, each group consisting of a certain number of parallel heddle harness frames to which the appropriate heddles are attached, according to a second embodied form of the present invention.

FIG. 4 illustrates the system of weaving a ten-frame satin fabric by overlapping two five-frame satin weaves according to another preferred embodiment of the invention. In FIG. 4, two parallel groups A and B each consisting of five heddle harness frames $A_1$, $A_2$, $A_3$, $A_4$, $A_5$ and $B_1$, $B_2$, $B_3$, $B_4$, $B_5$, respectively, are provided. Successive groups of heddles for receiving warp yarns are provided, each group consisting of ten heddles such as 1, 2, 3, 4, . . . , 10, 1, 2, 3, 4, . . . 10, and so forth as shown, and the individual heddles in each heddle group are attached to the appropriate harness frames in the two groups A and B in the following manner. That is, alternate heddles in each group, which are add-numbered 1, 3, 5, 7, 9, are operatively associated with the corresponding heddle harnes frames in the group A in the order of $A_1$, $A_2$, $A_3$, $A_4$, $A_5$ in group A, and the remaining heddles in the same group, which are even-numbered 2, 4, 6, 8, 10, are operatively associated with the corresponding heddle harness frames in group B in the sequence of $B_1$, $B_2$, $B_3$, $B_4$, $B_5$. Similarly to the earlier embodiment in FIG. 1, any two adjacent heddles in each heddle group are operatively linked to the harness frames in the different groups, such that for example, adjacent heddles 1 and 2 are linked to frames $A_1$ and $B_1$, respectively, adjacent heddles 3 and 4 are linked to frames $A_2$ and $B_2$, respectively, and so forth. In the above described embodiment, the raising or lowering operation of the heddle harness frames is repeated in each succeeding weft shooting or picking process, such that each one harness frame in each group is raised or lowered in the sequence of $A_1$–$B_3$, $A_5$–$B_2$, $A_4$–$B_1$, $A_3$–$B_5$, $A_2$–$B_4$, and the sequence is repeated for each succeeding weft shot. As a result, the heddles attached to the corresponding heddle frames are raised or lowered in the sequence of 1–6, 9–4, 7–2, 5–10, 3–8 for each succeeding weft shooting process and the sequence is repeated. In this embodiment, it is thus possible to obtain a tightly textured satin cloth which comprises a ten-frame woven structure including two overlapped five-frame satin weaves, as described in the earlier embodiment.

Figure 5:
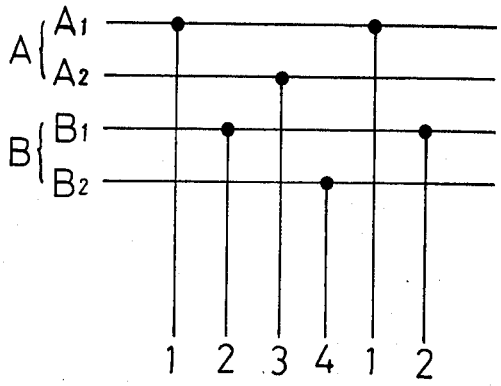
FIG. 5 illustrates the arrangement of part of the two harness groups, each group consisting of a certain number of parallel heddle harness frames to which the appropriate heddles are attached, according to a third embodied form of the present invention.

Although the foregoing description has been made in relation to the satin weaving process, the present invention can be applied similarly to the twill weaving and plain weaving processes, which are now described below by referring to FIGS. 5 and 6, respectively. FIG. 5 illustrates the system in a preferred embodiment of the invention for producing a four-frame twill weave. In this embodiment, two parallel frame groups A and B are provided, consisting of two heddle harness frames $A_1$, $A_2$ and $B_1$, $B_2$, respectively. Like the earlier described embodiments, the adjacent heddles are alternately linked to the heddle harness frames in the different groups A and B in the sequence of 1, 2, 3, 4, 1, 2, . . . , etc. as shown, such that a heddle 1 is linked to a frame $A_1$, a heddle 2 to a frame $B_1$, a heddle 3 to a frame $A_2$, a heddle 4 to a frame $B_2$, and so forth. For each succeeding weft shooting or picking process, therefore, the individual heddle harness frames in the two groups A and B are operated in the sequence of $A_1$, $B_1$, $A_2$, $B_2$, $A_1$, $B_1$, . . . , and so forth, to cause the corresponding heddles to be raised or lowered in the sequence of 1, 2, 3, 4, 1, 2, . . . 4, and so forth, thus allowing the weft yarns to pass between the warp yarns. The twill weaving process in FIG. 5 can effectively provide a four-frame twill fabric which is tightly structured by overlapping two two-frame twill weaves.

Figure 6:
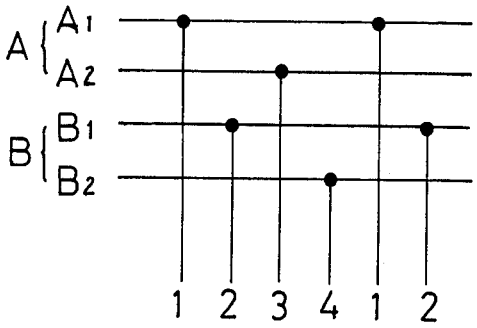
FIG. 6 illustrates the arrangement according to a fourth embodied form of the present invention.
Figure 7:
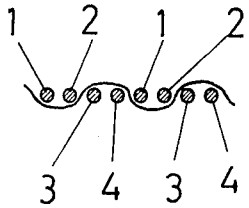
FIG. 7 is a partly enlarged sectional view of a plain weave produced according to the present invention.

The embodiment shown in FIG. 6 applies to the plain weaving process. As in the four-frame twill weaving process in FIG. 5, two parallel groups A and B of heddle harness frames are provided, each including two frames $A_1$, $A_2$ and $B_1$, $B_2$, respectively. As shown, a heddle 1 is operatively linked to a frame $A_1$, a heddle 2 to a frame $B_1$, a heddle 3 to a frame $A_2$, a heddle 4 to a frame $B_2$, and so forth. The raising or lowering operation of the heddle harness frames is repeated in each succeeding weft shooting or picking process, such that each one frame in each group is raised or lowered in the sequence of $A_1$–$B_1$, $A_2$–$B_2$ and the sequence is alternately repeated in each succeeding weft shot. As a result, the heddles attached to the corresponding heddle harness frames are raised or lowered in the sequence of 1–2, 3–4, and the sequence is alternately repeated. The plain weaving process in FIG. 6 can also effectively provide a plain fabric including two overlapped plain fabric structures. FIG. 7 shows the section of the thus woven plain fabric. As clearly viewed, the relationship between the warps and wefts is such that a weft yarn passes alternately under two warp yarns and over two warp yarns, thus ensuring the binding effect of the warp upon the weft. It is readily understood, therefore, that this provides a tightly structured plain weave.

The present invention which has fully been described with reference to the various embodied forms thereof provides the advantages of producing a tightly structured fabric which weighs less per meter of cloth than that of the conventional weaving method, regardless of whether it may be a plain weave, a satin weave, or a twill weave.

As readily understood from the foregoing description, those advantages can be achieved by providing two parallel groups each consisting a plurality of heddle harness frames to which the heddles are operatively attached in the described manner, and by causing the suceeding ajdacent heddles to be raised or lowered by raising or lowering the corresponding harness frames which alternate between the two harness frame groups. In the specific embodiments, the fabric weaving is advantageously accomplished by raising or lowering each individual harness frame in the different groups or by raising or lowering each one harness frame in each group to permit the corresponding heddles alternately to be raised or lowered for each succeeding weft shooting or picking process.

Although the present invention has been described by way of examples, it should be understood that various changes and modifications can be made without departing from the spirit and scope of the invention.

What I claim is:

1. In a process for weaving fabrics whereby warp yarns in different yarn groups are alternately raised and lowered to permit passage of weft yarns by causing corresponding heddle frames in different frame groups, to which heddles are operatively linked, alternately to be raised and lowered, the process comprising the steps of:

(1) connecting each individual succeeding warp yarn in one yarn group alternately to a corresponding heddle frame in the different frame groups according to a predefined pattern of connections of the warp yarns to the heddles;

(2) connecting each individual succeeding warp yarn in the remaining succeeding groups according to the same pattern as in step (1); and (3) causing one frame in one frame group to be raised or lowered and then one frame in another frame group to be raised or lowered, the raising or lowering being repeated for the frames in the different frame groups according to the predefined pattern of connections of the warp yarns to the respective heddles.

2. Process as defined in claim 1, wherein said process applies to any of plain weaving, twill weaving and satin weaving.

3. In a process for weaving fabrics whereby warp yarns in different yarn groups are alternately raised and lowered to permit passage of weft yarns by causing the corresponding heddle frames in different frame groups to which heddles are operatively linked, alternately to be raised and lowered, the process comprising the steps of:

(1) connecting each individual succeeding warp yarn in one yarn group alternately to a corresponding heddle frame in the different frame groups, according to a predefined pattern of connections of the warp yarns to the heddles;

(2) connecting each individual succeeding warp yarn in the remaining succeeding groups according to the same pattern as in step (1); and (3) causing one pair of frames in the different frame groups to be raised or lowered simultaneously and then another pair of frames in the different frame groups to be raised or lowered simultaneously, the raising or lowering being repeated for each pair of the remaining succeeding frames in the different frame groups according to the predefined pattern of connections of the warp yarns to the corresponding frames.

4. Process as defined in claim 3, wherein said process applies to any of plain weaving, twill weaving and satin weaving.

* * * * *